US008723091B2

(12) United States Patent
Rueger et al.

(10) Patent No.: US 8,723,091 B2
(45) Date of Patent: May 13, 2014

(54) INFRARED SEEKER HEAD

(75) Inventors: Roderich Rueger, Munich (DE); Juergen Zoz, Friedberg (DE)

(73) Assignee: LFK-Lenkflugkoerpersystem GmbH, Schrobenhausen (DE)

( * ) Notice: Subject to any disclaimer, the term of this patent is extended or adjusted under 35 U.S.C. 154(b) by 0 days.

(21) Appl. No.: 13/433,762

(22) Filed: Mar. 29, 2012

(65) Prior Publication Data

US 2012/0248238 A1 Oct. 4, 2012

(30) Foreign Application Priority Data

Mar. 30, 2011 (DE) ..... 10 2011 015 515

(51) Int. Cl.

| | |
|---|---|
| ***F41G 7/22*** | (2006.01) |
| ***F42B 15/01*** | (2006.01) |
| *F41G 7/00* | (2006.01) |
| *F42B 15/00* | (2006.01) |

(52) U.S. Cl.
USPC ..... 244/3.16; 244/3.1; 244/3.15; 244/3.19

(58) Field of Classification Search
USPC ..... 244/3.1–3.19; 343/700 R, 757, 763, 343/765, 766; 356/138, 139.04, 139.05; 250/200, 201.1, 203.1–203.7, 216, 250/234–236
See application file for complete search history.

(56) References Cited

U.S. PATENT DOCUMENTS

| | | | | | |
|---|---|---|---|---|---|
| 4,010,365 | A | * | 3/1977 | Meyers et al. | 250/236 |
| 4,085,910 | A | * | 4/1978 | Baker et al. | 244/3.16 |
| 4,123,134 | A | * | 10/1978 | Meyers | 244/3.16 |
| 4,155,521 | A | * | 5/1979 | Evans et al. | 244/3.16 |
| 4,199,762 | A | * | 4/1980 | Estlick et al. | 244/3.19 |
| 4,490,724 | A | * | 12/1984 | Bickman | 343/765 |
| 4,520,973 | A | * | 6/1985 | Clark et al. | 244/3.16 |
| 4,521,782 | A | * | 6/1985 | Pinson | 343/765 |
| 4,656,349 | A | * | 4/1987 | Pinson et al. | 250/203.1 |
| 4,690,351 | A | * | 9/1987 | Beckerleg et al. | 244/3.16 |
| 4,709,876 | A | * | 12/1987 | Pinson | 244/3.16 |
| 4,714,214 | A | * | 12/1987 | Schleimann-Jensen et al. | 244/3.16 |
| 4,907,009 | A | * | 3/1990 | Pinson | 343/766 |
| 4,999,491 | A | * | 3/1991 | Semler et al. | 250/236 |
| 5,064,285 | A | * | 11/1991 | Iddan | 356/139.05 |
| 5,279,479 | A | * | 1/1994 | Adama et al. | 244/3.16 |

FOREIGN PATENT DOCUMENTS

DE 103 13 136 A1 10/2004

* cited by examiner

*Primary Examiner* — Bernarr Gregory
(74) *Attorney, Agent, or Firm* — Crowell & Moring LLP

(57) ABSTRACT

A mount for a seeker head includes a plane spanned by a holder frame in which the pitch motion of the device containing at least one detector can be performed with respect to the missile structure and within the holder frame, at right angles to the plane spanned by the holder frame, a rotating mechanism for the rotational yaw motion of the device containing at least one detector is arranged about a rotation axis lying in the plane spanned by the holder frame. The pitch and yaw motion of the device is possible in a range of much more than+/−90°.

14 Claims, 1 Drawing Sheet

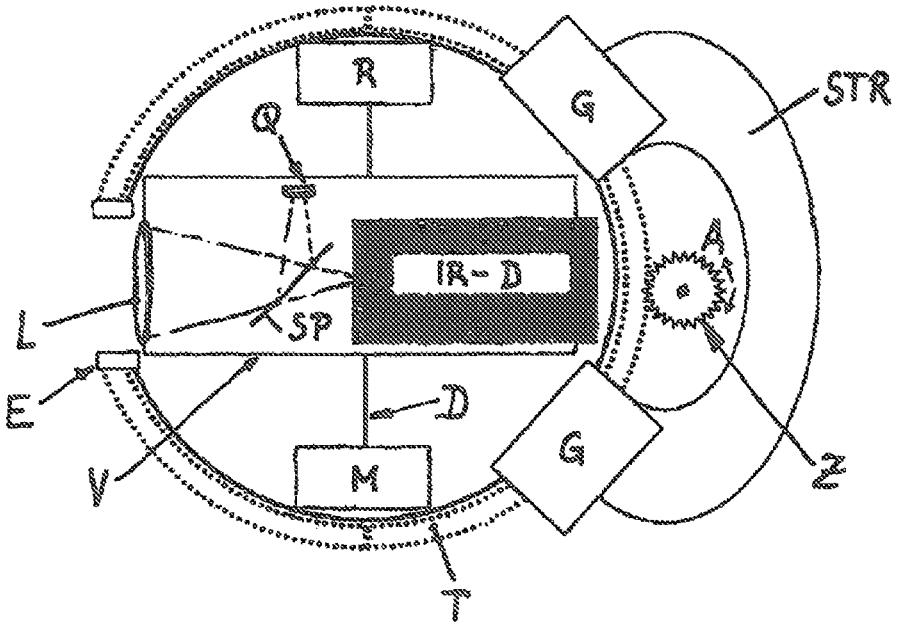
R
G
STR
Q
IR-D
A
L
SP
E
D
V
M
G
Z
T

INFRARED SEEKER HEAD

CROSS REFERENCE TO RELATED APPLICATION

The present application claims priority under 35 U.S.C. §119 to German Patent Application No. 10 2011 015 515.5-22, filed Mar. 30, 2011, the entire disclosure of which is herein expressly incorporated by reference.

BACKGROUND AND SUMMARY OF THE INVENTION

Exemplary embodiments of the present invention relate to a mount for a seeker head with a dual mode detector system, with a device in which at least one detector together with an optical system is arranged in a stationary manner, wherein the device is in active connection with at least one circular arc-shaped holder frame, wherein the holder frame is guided in at least one guide means which is fixedly connected to the missile structure and wherein the holder frame can be pivoted by means of a structurally fixed drive and the guide means grips around the holder frame in an arched manner.

Seeker heads of this type are used with missiles that continuously track a detected target. One example of a seeker head of this type is described in German Patent Document DE 103 13 136 A1. The platform bearing the optical system must thereby be gimbal mounted so that the optical axis of the system is able to adopt any desired position within a certain solid angle.

Depending on the type of gimbal mounting of the detector system, either the disadvantage of a singularity occurs in the region of the roll axis or only a solid angle to the roll axis of much less than 90° is achieved.

Exemplary embodiments of the present invention provide a mount for a seeker head that avoids the above-mentioned disadvantages and renders possible a pitch-pivot range of at least 90° to the roll axis.

In accordance with exemplary embodiment of the present invention a plane is spanned by the holder frame in which the pitch motion of the device containing at least one detector can be performed with respect to the missile structure and within the holder frame, at right angles to the plane spanned by the holder frame, a rotating mechanism for the rotational yaw motion of the device containing at least one detector is arranged about a rotation axis lying in the plane spanned by the holder frame.

This arrangement of the present invention provides a very simple mechanical construction compared to gimbal suspensions. Furthermore, no singularities occur in the region of the roll axis. The rotational yaw motion of the device is possible in a range of much more than +/−90° and the holder frame permits a pitch motion of somewhat more than 90°.

In accordance with an embodiment of the present invention the length of the circular arc-shaped holder frame is selected such that pitch motions by more than 90° are possible in both directions and the field of view of the optical system is kept free between the ends of the holder frame.

In accordance with an embodiment of the present invention the holder frame is composed of a T-bar. The drive of the circular arc-shaped holder frame is carried out by means of a toothing or also electromagnetically.

In accordance with the present invention the guide means can be a fork gripping around the holder frame. Usually, the device is composed of a single structural part that bears the optical system and the detectors.

BRIEF DESCRIPTION OF THE DRAWINGS

In the following, with the aid of the attached drawings, an exemplary embodiment of the invention will be addressed in further detail.

The sole figure diagrammatically illustrates one exemplary embodiment of the invention of the seeker head.

DETAILED DESCRIPTION OF THE INVENTION

The detectors IR-D and Q of the seeker head together with the optical system L and possibly necessary deflection mirror or beam splitter SP are mounted in a device V, which is embodied as a rigid platform. The device V thus contains the infrared detector IR-D and the 4-quadrant detector Q. No cardan joints or the like for tracking the detected target are provided inside the device. The tracking is carried out exclusively via drives that move the device V.

The device for the pitch motion is composed of a circular holder frame T, the guidance thereof in at least one guide means G and the drive A. The holder frame T is embodied as a circle segment that leaves a gap free between its two ends E, through which gap the radiation to be received can fall unhindered on the optical system L. The guide means G can be, for example, a fork gripping around the holder frame.

The holder frame T is composed of a profile with a preferably T-shaped cross-section, which has a high rigidity. At least one guide means G adapted to the profile holds the holder frame T and ensures a support free from play of the holder frame. The guide means themselves are fixedly connected to the missile structure STR, which also bears the drive A for the holder frame T.

The arrangement of the guide means G with respect to one another is carried out such that a pitch angle of at least +/−90° can be achieved before the ends E of the holder frame T strike the guide means G.

The drive of the holder frame is carried out free from play via a toothing Z on the back of the T-shaped holder frame, in which a gear wheel of the drive A engages. Other types of drives with similar properties as a gear drive can be used just as well.

The yaw drive M, R renders possible a rotation of the device V about a rotation axis D lying in the plane spanned by the holder frame T. The drive is carried out by means of a motor M, which rotates the device V inside the holder frame T in a plane that lies crosswise to the plane spanned by the holder frame. Furthermore, a resolver R is provided which compares the desired position with the actual position of the device V and carries out a corresponding direction alignment.

The entire pitch-pivot range is free from vignetting as long as a dome does not act restrictively. The dome should therefore be dimensioned somewhat larger than a hemisphere in order to be able to fully utilize the pivot range of the device according to the invention. This arrangement thus meets all of the requirements set at the outset with more than 90° look angle in the semi-space. Furthermore, no singularity occurs during pivoting about the main axis and a simple optical system can thus be used. Furthermore an arrangement of this type can be embodied in a very compact manner so that the integration into very slim missiles is also possible.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE CHARACTERS

A Drive (pitch)
D Rotation axis (yaw)
E Ends of the holder frame
G Guide means
IR-D Infrared detector
L Optical system
M Drive (yaw)
Q 4-quadrant detector
R Resolver
SP Beam splitter
STR Missile structure
T Holder frame
V Device
Z Toothing

What is claimed is:

1. A mount for a seeker head with a dual mode detector system, the mount comprising:

at least one circular arc-shaped holder frame actively connected to a device, wherein the device includes at least one detector and an optical system arranged in a fixed positional relationship with respect to each other; and at least one guide means, which is arranged to guide the at least one circular arc-shaped holder frame and which is fixedly connected to a missile structure, wherein the at least one circular arc-shaped holder frame is pivotable by a structurally fixed drive about a pivot axis and the at least one guide means grips around the at least one circular arc-shaped holder frame in an arched manner, wherein the device containing the at least one detector is moveable about the pivot axis in a pitch motion with respect to the missile structure, and wherein a rotating mechanism for the rotational motion of the device containing the at least one detector about a rotation axis, which is perpendicular to the pivot axis, is arranged within the at least one circular arc-shaped holder frame.

2. The mount according to claim 1, wherein the at least one circular arc-shaped holder frame is configured with a particular length such that pitch motions by more than 90° are possible in both directions and the field of view of the optical system is kept free between the ends of the at least one circular arc-shaped holder frame.

3. The mount according to claim 1, wherein the at least one circular arc-shaped holder frame is composed of a T-bar.

4. The mount according to claim 1, wherein the fixed drive is a gear drive.

5. The mount according to claim 1, wherein the fixed drive is an electromagnetic drive.

6. The mount according to claim 1, wherein the guide means is a fork gripping around the at least one circular arc-shaped holder frame.

7. The mount according to claim 1, wherein the device is composed of a single structural part that bears the optical system and the detectors.

8. A mount for a seeker head with a dual mode detector system, the mount comprising:

at least one circular arc-shaped holder frame actively connected to a device, wherein the device includes at least one detector and an optical system arranged in a fixed positional relationship with respect to each other; and at least one guide, which is arranged to guide the at least one circular arc-shaped holder frame and which is fixedly connected to a missile structure, wherein the at least one circular arc-shaped holder frame is pivotable by a structurally fixed drive about a pivot axis and the at least one guide grips around the at least one circular arc-shaped holder frame in an arched manner, wherein the device containing the at least one detector is moveable about the pivot axis in a pitch motion with respect to the missile structure, and wherein a rotating mechanism for the rotational motion of the device containing the at least one detector about a rotation axis, which is perpendicular to the pivot axis, is arranged within the at least one circular arc-shaped holder frame.

9. The mount according to claim 8, wherein the at least one circular arc-shaped holder frame is configured with a particular length such that pitch motions by more than 90° are possible in both directions and the field of view of the optical system is kept free between the ends of the at least one circular arc-shaped holder frame.

10. The mount according to claim 8, wherein the at least one circular arc-shaped holder frame is composed of a T-bar.

11. The mount according to claim 8, wherein the fixed drive is a gear drive.

12. The mount according to claim 8, wherein the fixed drive is an electromagnetic drive.

13. The mount according to claim 8, wherein the guide is a fork gripping around the at least one circular arc-shaped holder frame.

14. The mount according to claim 8, wherein the device is composed of a single structural part that bears the optical system and the detectors.

* * * * *